United States Patent [19]
Futros

[11] Patent Number: 4,478,291
[45] Date of Patent: Oct. 23, 1984

[54] DRILLING RIG

[75] Inventor: Ernest M. Futros, Rosser, Canada

[73] Assignee: Canadian Drilling Equipment Ltd., Calgary, Canada

[21] Appl. No.: 353,064

[22] Filed: Mar. 1, 1982

[30] Foreign Application Priority Data

Jan. 8, 1982 [CA] Canada ..... 393809

[51] Int. Cl.³ ..... E21C 5/06
[52] U.S. Cl. ..... 173/147; 173/152
[58] Field of Search ..... 173/147, 152, 122, 123, 173/124; 92/137, 136; 187/9 R, 17, 26; 175/122, 162; 74/110, 41; 254/29 R, 89 R, 386, 277

[56] References Cited

U.S. PATENT DOCUMENTS 3,288,229 11/1966 Chappuis ..... 173/147
3,512,072 5/1970 Karazija et al. ..... 187/9 R
3,645,343 2/1972 Mays ..... 173/147
3,692,123 9/1972 Gyongyosi ..... 173/147
3,708,024 1/1973 Back ..... 173/147
3,986,564 10/1976 Bender ..... 173/151

*Primary Examiner*—Frank T. Yost
*Assistant Examiner*—Hien H. Phan
*Attorney, Agent, or Firm*—Laff, Whitesel, Conte & Saret

[57] ABSTRACT

This invention relates to a mobile drilling rig used for deep wells. The mast structure can be made considerably lighter than previously by translation of the drilling string lifting pressure against the bottom of the mast rather than being supported by the mast itself. A hydraulic cylinder extending upwardly within the raised mast bears against the bottom of the mast, and has a pulley at its top over which a lifting chain passes. One end of the chain is linked to the bottom of the mast, the other to the top drive. As the cylinder extends, the top drive rises, lifting the drilling string, but with virtually the entire lifting force against the bottom of the mast.

3 Claims, 2 Drawing Figures

DRILLING RIG

FIELD OF THE INVENTION

This invention relates to drilling rigs, and particularly to deep drilling mobile drilling rigs.

DESCRIPTION OF THE PRIOR ART

A mobile drilling rig is usually comprised of a mast which is transported horizontally on a truck, and which is swivelled into a vertical, operating configuration at the drilling site.

Drilling pressure is applied against the top of a series of drilling pipes via a top drive which is guided along the mast. The top drive is linked to a hydraulic cylinder fixed to the top of the mast, the cylinder extending downward within the mast. Usually the maximum pressure to be exerted by the hydraulic cylinder is applied during the phase in which the drilling pipe must be lifted out of the ground and occurs when the hydraulic cylinder contracts. The pressure exerted by the hydraulic cylinder must be sufficient to counteract the weight of the drilling pipe and the pipe friction against the sides of the drilled hole.

Mobile drilling rigs have been used to drill to a maximum of about 4,000–5,000 feet in depth, using, for example, 3 inch outside diameter pipe, in sections 20 feet in length. For such deep wells the hoisting capacity of the drilling rig has been required to be approximate 150,000 pounds, which includes some safety factor.

The drilling depth capacity of mobile drilling rigs has been limited by the required strength of the mast, which reaches a practical limit when the required strength of the mast dictates the use of structural members which have a combined weight exceeding the carrying capacity of its vehicle and exceeding their ability to retain structural integrity when tilted from horizontal to vertical orientation. The use of increased capacity vehicles also prohibits their use on roads having maximum weight limitations.

The drilling depth limitation of mobile drilling rigs clearly prohibits their use for drilling very deep wells, e.g. in excess of 5,000 feet, which is often required in the search for oil. Consequently for such deep wells a permanent drilling rig must be built on site with the required mast strength, which is clearly a much more expensive undertaking than would be required if a mobile drilling rig could be used.

SUMMARY OF THE INVENTION

The present invention is a mobile drilling rig which provides means for drilling wells substantially in excess of 5,000 feet. The capacity of the mast can be built to provide a lift capacity of, e.g. 100,000 pounds; and the principles of the invention can be used to provide lift capacities in excess of this level. Therefore for the first time, mobile drilling rigs can be used to drill deep oil wells, which previously could only be drilled using fixed masts.

In the present invention, the lifting and, if desired, the drilling pressure force is exerted against the bottom of the mast, rather than against the top of the mast and thus which force was transmitted through and was supported by the mast as in prior art designs. Accordingly the mast need only be designed to maintain the top drive and other apparatus retained by the mast in proper alignment, and to withstand forces associated therewith (including drilling force if desired). However it will be appreciated that these forces are considerably less than the major lifting force which previously limited the capacity of the mast, and which now, in accordance with the present invention, is substantially removed from the mast itself.

In general, the invention is a drilling rig comprising a mast, a top drive adapted to be moved vertically along the mast, a hydraulic cylinder having one end fixed to the bottom of the mast and extending toward the top of the mast parallel to the axis of the mast, a lifting pulley rotatably fixed to the other end of the hydraulic cylinder, and a lifting chain having one end fixed to the top drive, passing over the lifting pulley and the other end fixed to the bottom of the mast. Upon extension of the hydraulic cylinder, the lifting pulley rises, causing the chain to lift the top drive. The other end of the chain exerts tension against the bottom of the mast and the end of the hydraulic cylinder fixed to the bottom of the mast exerts pressure against the bottom of the mast, whereby the lifting force is exerted against the bottom of the mast.

Clearly the mast need not be designed to withstand the maximum lifting force, since the major component of the force is exerted against its bottom, instead of its structure.

It should be understood that the words "bottom of the mast" as used in this specification are intended to mean either one end of the mast itself (the lower end or structural members which bear against it when the mast is in its vertical orientation), or a structural member which is part of the carrying vehicle, and consequently is braced against the ground during the drilling operation. It is not essential that the "bottom of the mast" should actually be part of the mast, but it is sufficient that it should be an element which can withstand the vertical component of force which is directly related to the lifting capacity of the apparatus. The mast itself can be in some way linked to this element in order to ensure that the top drive does not move laterally relative to the drilling position as it is guided up and down the mast.

BRIEF DESCRIPTION OF THE DRAWINGS

A detailed description of the invention will be described below with reference to the following drawings, in which.

DESCRIPTION OF THE PREFERRED EMBODIMENTS

Figure 1:
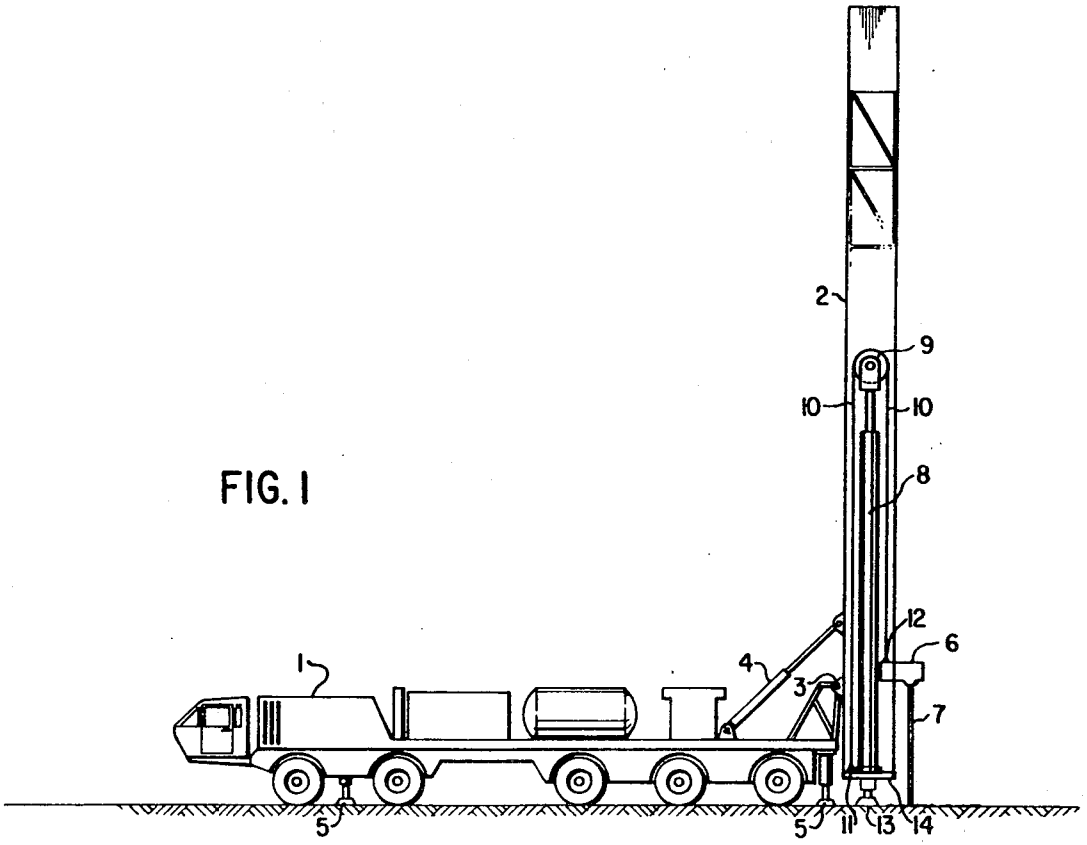
FIG. 1 is a schematic side view illustrating the invention in simplest form.

Turning now to FIG. 1, a schematic side view of the mobile drilling rig illustrating the principles of the invention is shown. A mobile rig comprising a truck body 1 has a mast 2 supported on it in a manner similar to prior art mobile masts. The mast 2 swivels about an axis 3, and during transportation the mast 2 lies horizontally along the top of the truck body whereby it can be transported to the drilling site. At the drilling site the mast 2 is elevated by means of a hydraulic cylinder 4. During the drilling operation the truck body is braced against the ground by means jack 5.

Also as in the prior art, a top drive 6 is guided along the mast 2, for exerting drilling pressure against a drilling pipe 7. When the top drive 6 has driven a pipe into the ground and has reached the bottom of the mast, the top of the pipe which is accessible above the ground is detached from the top drive, the top drive is raised to the top of the mast, and another pipe is fixed between the top of drilling pipe 7 and top drive 6, and the process repeats itself.

As noted earlier, the rig can be called upon to drill holes as deep as several thousand feet. The actual drilling action at the bottom of the hole is facilitated by a drill bit lubricated by drilling mud which is passed down the center of the pipe through the top drive. The downward drilling pressure is aided by the weight of the pipe, and the total drilling pressure need only be as great as is required to apply the drill bit to the rock or other material to be drilled.

However the drill pipe must be extracted from the hole from time to time, to change the drilling bit or to extract core samples, or upon completion of the hole to the required depth. It is clear that several thousand feet of pipe requires the exertion of substantial lifting force.

As noted earlier, prior art drilling rig mechanisms have provided drilling pressure from a hydraulic cylinder which pressure is exerted downwardly from the top of the mast, against the top drive. Lifting pressure was exerted by contraction of the hydraulic cylinder. This pressure, greater than the drilling pressure, is translated to the bottom of the mast, and thus to the ground through the mast structure itself.

According to the present invention, the lifting force, the major force involved in the drilling operation, is translated to the bottom of the mast 14. As may be seen in FIG. 1, according to the principles of this invention a long hydraulic cylinder 8 has one end disposed against the bottom of the mast 14, and the other end has a large pulley 9 attached thereto. A lifting chain 10 is attached to the bottom of the mast at an attachment point 11, passes over the pulley 9 and is fixed to top drive 6 e.g. at attachment point 12. Accordingly as hydraulic cylinder 8 extends, pulley 9 rotates and lifts the lifting chain, which lifts top drive 6 within guides set along the mast 2.

It may be seen that substantially all of the lifting pressure is exerted against the bottom of the mast. A mast jack 13 is used between the bottom of the mast and the ground, in order to transmit the lifting pressure against the ground, although this force can be transmitted through the truck jacks if so designed.

Figure 2:
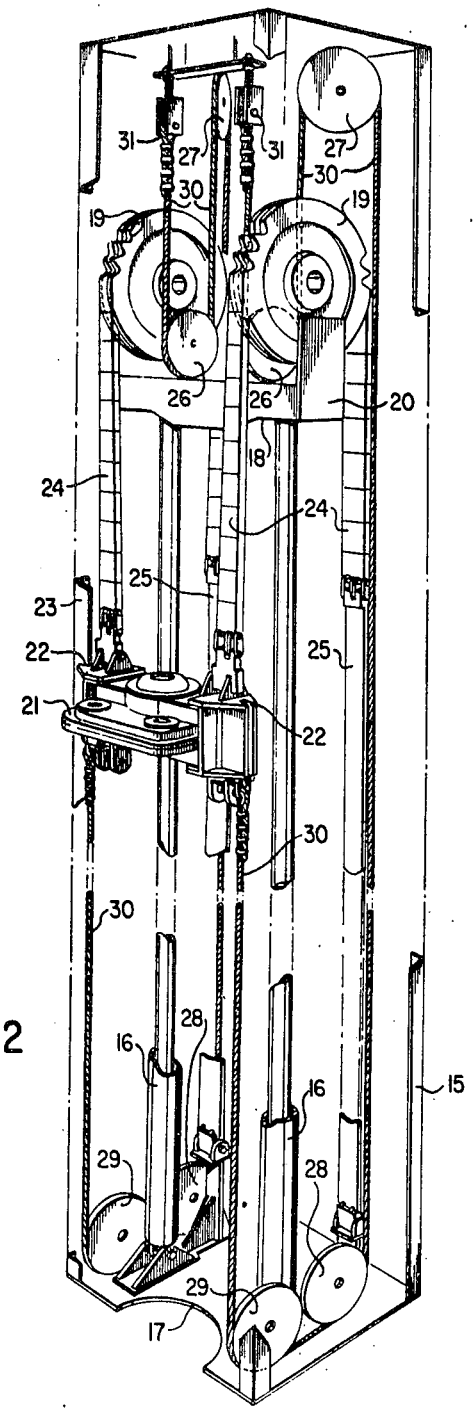
FIG. 2 is a perspective partly phantom view of the preferred form of the lifting mechanism.

While the above illustrates the principles of the invention, a practical embodiment of the lifting mechanism is shown in FIG. 2.

FIG. 2 illustrates a mast frame 15 shown in phantom. A pair of hydraulic cylinders 16 are pinned to the bottom 17 of the mast frame 15. The frame of course can be fabricated so that the bottom bears against a jack, or against some other structure linked to the truck body which can be braced against the ground which will allow the hydraulic cylinders to rotate about the mast swivelling point with the frame yet be held with integrity relative to the frame.

The tops of hydraulic cylinders 16 bear against a pulley frame 18, which is contained within the mast frame and is guided along conventionally constructed vertical guides within the frame. A pair of lifting pulleys 19, preferably peripherally toothed are oppositely spaced in parallel planes, and are retained on a single axle rotatably fixed to the pulley frame 18. The axle is not shown for clarity of illustration of other components associated with this mechanism but the axle can be of conventional construction, and is retained by the pulley frame by conventional means. In this respect it should be noted that the pulley frame is comprised of two vertical members 20 (only one of which is shown) which can slide within vertical guides and are joined by a horizontal beam 21 against which hydraulic cylinders 16 bear.

A top drive 21 of conventional construction is also retained between vertical guides fixed to the mast frame as an example of vertical guides which can be used, the top drive utilizes a pair of spaced and oppositely facing vertical slots 22 within which vertical guide beams fixed to the frame 15 are retained. Accordingly the top drive 21 is fixed in lateral position, but can slide up and down the mast between guide beams 23.

A pair of lifting chains 24 each have one of their ends linked to the top of the top drive 21, and pass over lifting pulleys 19 and are fixed to the bottom of the mast frame. The lifting chains are preferably retained by the teeth of lifting pulley 19.

In order to increase the strength and decrease the cost of the chain, which clearly carry the full lifting force, lengths of strapping 25 can be used between the bottom of the frame 17 to a point mid-way up the travel distance of top drive 21, chain 24 being linked to the tops of straps 25.

A second pair of pulleys 26 are fixed to a single axle, which is also rotatably retained by pulley frame 18. If desired, of course, each pulley 26 can have its own axle which is linked to pulley frame 18 by conventional means. A further pair of pulleys 27 are retained at the top of the mast frame, and two further pairs of pulleys 28 and 29 are retained at the bottom of the mast frame, each pair of pulleys 28 and 29 being rotatably retained in a single plane, at one side of the mast frame in spaced relationship.

Each one of a pair of cables 30 is fixed to the bottom of top drive 21, passes around the bottoms of pulleys 28 and 29, around the top of pulley 27, around the bottom of the pulley 26, and is fixed to the top of the frame 15 at adjustable link 31. The adjustable link is used to release or eliminate cable and chain slack in the system.

In operation, let us assume that the top drive is at the bottom of its travel held within its guides. Drilling pipe fixed to the top drive must be pulled upwardly. Hydraulic cylinders 16 are caused to extend using conventional hydraulic controls. The cylinders bear against pulley frame 18, which begins to rise. As it rises, lifting pulleys 19 are lifted, and with them, chains 24. Since chains 24 are fixed at one end to the bottom of the mast frame, the lifting pulleys are caused to rotate, and lifting force is exerted against top drive 21, which is caused to move upwardly. It will be recognized that the top drive moves upwardly twice the distance and at twice the speed of extension of the hydraulic cylinders.

It should be noted that the lifting force is exerted against four points, all of them on the floor or the end of the mast frame, and none are against the sides or top of the mast frame. Two of the points are where the hydraulic cylinder bears against the bottom of the mast frame, and the other two points are where the chain or strapping attached to the chain is attached to the bottom of the mast frame. It is therefore clear that the mast frame need not be designed to absorb the lifting capacity of the drilling rig, as was required in prior art mobile drilling rigs.

As top drive 21 rises, tension is exerted against cables 30. However as pulley frame 18 rises, the amount of cable between link 31, pulley 26 and pulley 27 decreases, providing slack to relieve the tension noted above. While top drive 21 moves upwardly twice the distance of pulley frame 18, the amount of slack provided by upward movement of pulley 26 is twice the upward movement distance of pulley frame 18, compensating thereby.

In order to exert drilling pressure, top drive 21 must be driven downwardly. Hydraulic cylinders 16 are caused to contract, lowering pulley frame 18. This causes pulleys 26 to move downwardly, exerting tension on cable 30. The tension is translated to the top drive 21, forcing it downward. However since pulley frame 18 has lowered, slack is provided in chain 24, which allows top drive 21 to lower. The amount of cable drawn, and the amount of chain given are compensating in the precise reverse direction to that described earlier concerned with providing lifting force.

It may be seen that the provision of drilling pressure translates some force to the top of the mast frame. However a substantial part of this force is exerted as tension against the bottom of the mast frame. More of it can be transferred to the bottom of the mast frame by changing links 31 to additional pulleys, and running the cables over them, to the bottom of the mast frame where they are fixed. However, it should be noted that the major force required in drilling is the lifting force, rather than the drilling force, since substantial downward pressure is not necessary and may not be desirable in order to maintain a balance between drilling speed and wear of the drill bit, and since some of the downward pressure is provided by the weight of the pipes.

It has been found that the structure described above can be used in the construction of mobile drilling rigs which can drill to depths previously only attainable utilizing fixed masts. Accordingly a very major component of cost to the drilling company is avoided.

A person understanding this invention may now conceive other designs, other embodiments or variations of this design, using the principles of this invention. All are considered to be within this sphere and scope of the invention as defined in the claims appended hereto.

I claim:

1. A drilling rig comprising:

a mast, (b) a top drive adapted to be moved vertically along the mast, (c) a hydraulic cylinder having one end linked to the bottom of the mast, and having its other end extending toward the top of the mast parallel to the axis of the mast, (d) a lifting pulley rotatably fixed to the other end of the hydraulic cylinder, (e) lifting chain means having one end fixed to the top drive passing over the lifting pulley and having its other end linked to the bottom of the mast, whereby upon extension of the hydraulic cylinder, the lifting pulley rises, causing the chain to lift the top drive, said other end of the chain exerting tension against the bottom of the mast and said one end of the hydraulic cylinder exerting pressure against the bottom of the mast, the lifting force thus being exerted against the bottom of the mast, and further comprising:

(f) a first pulley rotatably fixed to said other end of the hydraulic cylinder, (g) a second pulley rotatably fixed to the top of the mast, (h) a third pulley rotatably fixed to the bottom of the mast, (i) a cable having one end fixed to the top of the mast, passing under the first pulley, passing over the second pulley, passing under the third pulley, and having its other end fixed to the top drive, whereby upon contraction of the hydraulic cylinder, the cable is pulled downward by the first pulley, the cable pulling the top drive downward, the hydraulic cylinder further drawing down the lifting pulley, allowing the top drive to draw down the lifting chain means.

2. A drilling rig as defined in claim 1, further including a pulley carrier for rotatably supporting the lifting pulley and first pulley by their axles, said other end of the hydraulic cylinder bearing against the pulley carrier for exerting lifting and drilling force thereto.

3. A drilling rig as defined in claim 1 or 2 in which the mast is supported by a truck body and is linked adjacent the end of said body at a swivel point and a hydraulic cylinder being linked between the truck body and the mast for raising the mast from a horizontal to a vertical orientation about the swivel point.

* * * * *